US006257216B1

(12) United States Patent
Förster et al.

(10) Patent No.: US 6,257,216 B1
(45) Date of Patent: Jul. 10, 2001

(54) DEVICE FOR SUPPRESSING UNDESIRED IGNITIONS IN A SPARK IGNITION ENGINE

(75) Inventors: Ralf Förster, Regensburg; Alfons Fisch, Falkenstein, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/533,758

(22) Filed: Mar. 23, 2000

Related U.S. Application Data

(63) Continuation of application No. PCT/DE98/02830, filed on Sep. 23, 1998.

(30) Foreign Application Priority Data

Sep. 23, 1997 (DE) ..... 197 41 963

(51) Int. Cl.[7] ..... F02P 3/00; H05B 41/36

(52) U.S. Cl. ..... 123/652; 315/209 T; 123/655; 123/650; 327/432; 327/564

(58) Field of Search ..... 123/652, 653, 123/655, 650; 315/209 CD, 209 M, 209 T; 327/432, 434, 564

(56) References Cited

U.S. PATENT DOCUMENTS

| | | | | |
|---|---|---|---|---|
| 3,897,767 | * | 8/1975 | Gordon et al. | 123/607 |
| 3,949,722 | | 4/1976 | Linstedt et al. | 123/651 |
| 4,993,396 | * | 2/1991 | Miura | 123/651 |
| 5,327,320 | * | 7/1994 | Fischer | 361/152 |
| 5,379,745 | * | 1/1995 | Volgel et al. | 123/655 |
| 5,392,754 | * | 2/1995 | Hopper et al. | 123/609 |
| 5,603,308 | * | 2/1997 | Ooyabu et al. | 123/644 |
| 5,970,964 | * | 10/1999 | Furuhata et al. | 315/209 T |

FOREIGN PATENT DOCUMENTS

| | | |
|---|---|---|
| 73 198 | 5/1970 | (DE) . |
| 29 27 058 | 1/1980 | (DE) . |
| 196 12 984 A1 | 9/1996 | (DE) . |
| 0 323 412 | 7/1989 | (EP) . |
| 0 370 301 | 5/1990 | (EP) . |
| 7122290 | 1/1973 | (FR) . |

OTHER PUBLICATIONS

Japanese Patent Abstract No. 07243369 (Naoto), dated Sep. 19, 1995.
Japanese Patent Abstract No. 09209892 (Ryoichi), dated Aug. 12, 1997.
Japanese Patent Abstract No. 09177647 (Noboru), dated Jul. 11, 1997.

* cited by examiner

*Primary Examiner*—Henry C. Yuen
*Assistant Examiner*—Hieu T Vo
(74) *Attorney, Agent, or Firm*—Herbert L. Lerner; Laurence A. Greenberg; Werner H. Stemer

(57) ABSTRACT

The primary winding of an ignition coil is connected in series with an ignition switch that can be switched by a control circuit. A circuit including a capacitor, a resistor, and a diode is configured between the control terminal and the collector of the ignition switch. When the primary current is switched on, the capacitor discharge brings about a voltage reduction at the base of the ignition switch resulting in slowing down the trailing voltage edge at the collector of the ignition switch.

3 Claims, 1 Drawing Sheet

DEVICE FOR SUPPRESSING UNDESIRED IGNITIONS IN A SPARK IGNITION ENGINE

CROSS-REFERENCE TO RELATED APPLICATION

This is a continuation of copending International Application PCT/DE98/02830, filed Sep. 23, 1998, which designated the United States.

BACKGROUND OF THE INVENTION

Field of the Invention

The invention relates, in general, to a device for suppressing undesired ignitions in a spark ignition engine. Such a device is known from EP 0 370 301 A1.

If an ignition coil is energized by an ignition output stage when a spark ignition engine is being controlled, the switch-on signal edge induces a voltage on the secondary side of the ignition coil when the primary circuit is switched on. This voltage is capable of generating an ignition spark at the spark plug given specific operating states of the spark ignition engine. Such an ignition spark can lead to undesired ignition of the petrol/air mixture, and can damage the engine because of an excessively early ignition angle.

An ignition coil is a system that is capable of oscillating and that is made of inductors and parasitic capacitors. If the system has a switch-on signal edge applied to it, among other things, the secondary winding is excited so that it undergoes damped oscillation, which can reach a voltage amplitude that is virtually twice as high as the voltage determined by the transformer property of the ignition coil.

For this reason, efforts are made to slow down the switching-on process of the ignition coil in such a way that no oscillation is excited, and the secondary voltage thus assumes only the voltage value that is determined by the transformer property of the ignition coil.

In the circuit that is known from EP 0 370 301 A1, a passive damping network is used that is configured between the positive pole and the negative pole of the voltage source of a vehicle's electrical system. The passive damping network is made of a series circuit including two resistors and a capacitor and has an output that is connected to the connecting point between the ignition switch and primary winding of the ignition coil. The fact that the voltage at the capacitor that discharges via the ignition switch decreases when the ignition switch is switched on slows down the voltage drop at the ignition switch. For this purpose, a large capacitance value of the capacitor is already necessary for the anticipated current limiting of the primary current. The capacitor without such current limiting would have to assume unrealistically high values in order to be able to cause the switching-on signal edge of the primary current to slow down.

Further circuits of this type can be found in DE 29 27 058 A1 and DE 196 12 984 A1.

SUMMARY OF THE INVENTION

It is accordingly an object of the invention to provide a device for suppressing undesired ignitions which overcomes the hereinafore-mentioned disadvantages of the heretofore-known devices of this general type in such a way that a significantly lower valued capacitor is required.

With the foregoing and other objects in view there is provided, in accordance with the invention, a device for suppressing undesired ignitions in a spark ignition engine.

The device includes a voltage source having a positive pole and a negative pole, an ignition switch having a base and a collector, and at least one spark plug. Additionally, an ignition coil having a primary winding and a secondary winding is provided. The secondary winding is connected to the spark plug. The primary winding and the ignition switch are connected in series between the positive pole and the negative pole of the voltage source. A control circuit is provided for switching the ignition switch. A first resistor connects the control circuit to the base. A second resistor having a first terminal and a second terminal is provided. The second terminal is connected to the negative pole. A capacitor has a first terminal connected to the collector and a second terminal connected to the first terminal of the second resistor. A diode is provided for conducting a current away from the base. The diode is connected between the second terminal of the capacitor and the base.

Other features which are considered as characteristic for the invention are set forth in the appended claims.

Although the invention is illustrated and described herein as embodied in a device for suppressing undesired ignitions in a spark ignition engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
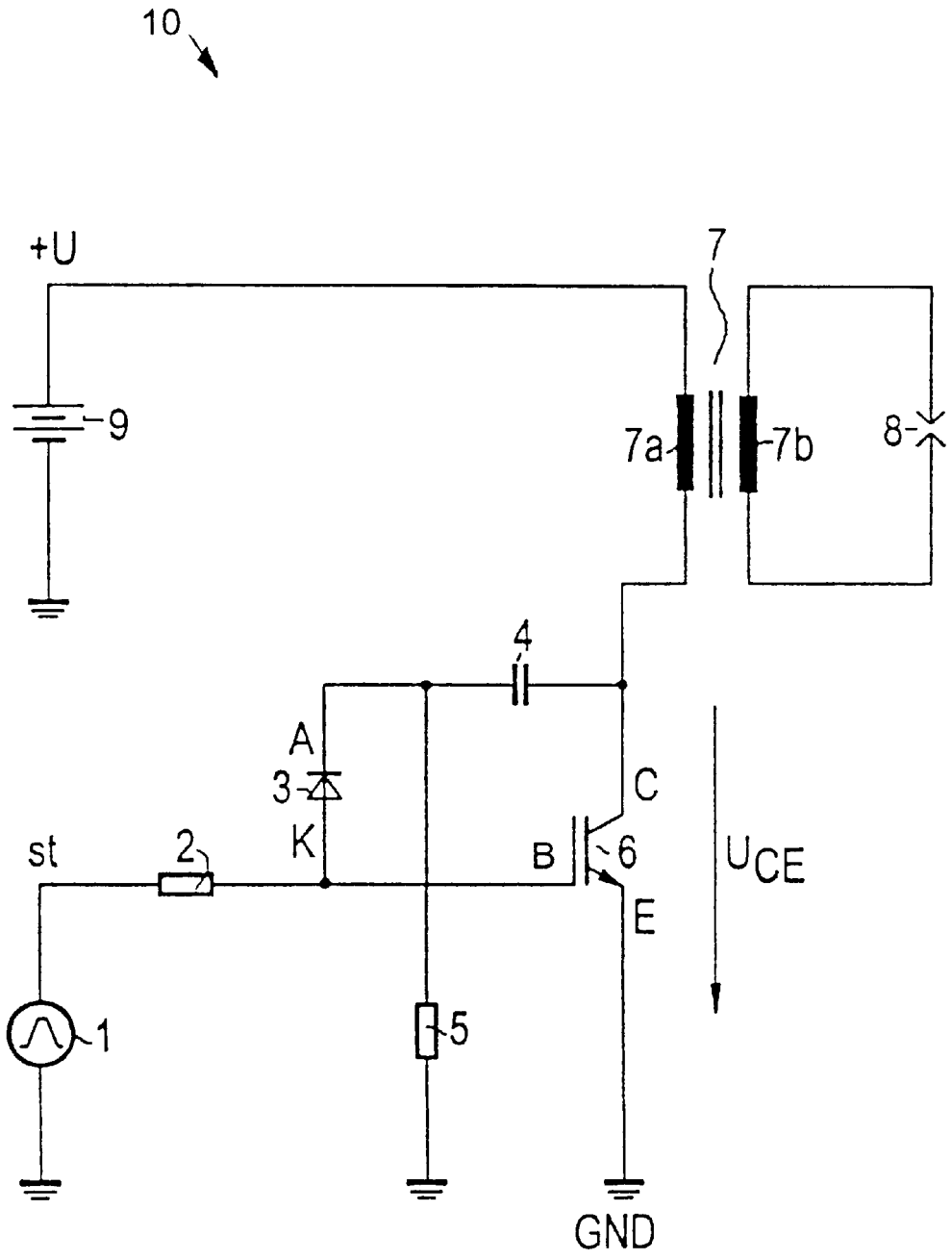
FIG. 1 shows an ignition output stage for a spark ignition engine.

Referring now to figure of the drawing in detail, there is seen an ignition output stage 10 of a spark ignition engine (not illustrated). The primary winding 7*a* of an ignition coil 7 is connected in series with an ignition switch 6 between the positive pole +U and the negative pole GND of the voltage source 9 of a vehicle's electrical system. The secondary winding 7*b* of the ignition coil 7 is connected to at least one spark plug 8. The ignition switch 6 is embodied as a so-called IGBT (Isolated Gate Bipolar Transistor), which corresponds to a Darlington circuit of an MOS transistor or of a bipolar transistor.

The control terminal B of the ignition switch 6 is gate terminal when using an MOS transistor and is a base terminal when using a bipolar transistor as shown in the exemplary embodiment. The control terminal B of the ignition switch 6 is connected via a first resistor 2 to a control circuit 1 which supplies a control signal st for the period during which the primary circuit is switched on. This control circuit 1 is as a rule a microcontroller of an engine control device that is used to control the functions of the spark ignition engine. The microcontroller is assigned a defined internal resistance by the first resistor 2.

A series circuit including a capacitor 4 connected to the collector terminal C and a second resistor 5 is configured between the collector terminal C of the ignition switch 6 and the negative pole GND. A diode 3 that conducts current away from the control terminal B is configured between the control terminal B and the connecting point of the capacitor 4 and resistor 5.

This embodiment permits the circuit to be integrated easily into integrated circuits.

The device described operates in the following manner. When the ignition switch 6 is nonconductive the capacitor 4 is charged to the voltage U of the voltage source 9 of the vehicle's electrical system.

A control signal st is applied to the control terminal B to switch on the ignition output stage 10. As the signal edge of the control signal st rises, the ignition switch 6 is switched on, as a result of which the voltage UCE between the collector terminal C and the emitter terminal E of the ignition switch 6 goes toward zero. The decreasing collector emitter voltage $U_{CE}$ gives rise to a current flow from the control circuit 1, usually a microcontroller, through the diode 3, the capacitor 4 and the ignition switch 6 to the negative pole GND. Thus a voltage drop is created at the two resistors 2 and 5.

The voltage drop at the first resistor 2 reduces the voltage at the control terminal B to the value of the threshold voltage for the ignition switch 6. The capacitor 4 is discharged by the second resistor 5 after the voltage at the collector terminal C has reached its saturation value. Because this is negative feedback, the "slew rate" of the trailing edge of the collector-emitter voltage UCE is limited. The ignition switch 6 is operated as an amplifier in the time period when the primary current is rising (the decreasing collector-emitter voltage UCE).

When the ignition output switch is switched off at the ignition time when the collector-emitter voltage $U_{CE}$ is rising again, the diode 3 prevents negative feedback via the capacitor 4.

If a vehicle electrical system voltage of 12 V is used, for example, to slow down the trailing edge of the collector-emitter voltage $U_{CE}$ by 100 $\mu$s the circuit according to the invention requires a capacitance value for the capacitor 4 of approximately 22 nF. In contrast, the known circuit would require a value of approximately 100 $\mu$F.

We claim:

1. A device for suppressing undesired ignitions in a spark ignition engine, comprising:

a voltage source having a positive pole and a negative pole;

an ignition switch having a base and a collector;

at least one spark plug;

an ignition coil having a primary winding and a secondary winding, said secondary winding connected to said spark plug, said primary winding and said ignition switch connected in series between said positive pole and said negative pole;

a control circuit for switching said ignition switch;

a first resistor connecting said control circuit to said base;

a second resistor having a first terminal and a second terminal, said second terminal connected to said negative pole;

a capacitor having a first terminal connected to said collector and a second terminal connected to said first terminal of said second resistor; and a diode for conducting a current away from said base, said diode connected between said second terminal of said capacitor and said base.

2. The device according to claim 1, wherein said ignition switch is an isolated gate bipolar transistor.

3. The device according to claim 1, wherein said ignition switch, said control circuit, said first resistor, said second resistor, said capacitor, and said diode are configured in an integrated circuit.

* * * * *